US005511324A

United States Patent [19]

Smith

[11] Patent Number: 5,511,324

[45] Date of Patent: Apr. 30, 1996

[54] SHOE HEEL SPRING

[76] Inventor: Roosevelt Smith, P.O. Box 3184, Flint, Mich. 48502

[21] Appl. No.: 169,226

[22] Filed: Apr. 1, 1994

[51] Int. Cl.[6] ..... A43B 13/28

[52] U.S. Cl. ..... 36/27; 36/38

[58] Field of Search ..... 36/42, 27, 28, 36/31, 35 R, 37, 38

[56] References Cited

U.S. PATENT DOCUMENTS

| | | | |
|---|---|---|---|
| 458,010 | 8/1891 | Beach | 36/38 |
| 2,387,334 | 10/1945 | Lemke | 36/38 |
| 2,454,951 | 11/1948 | Smith | 36/38 |
| 3,886,674 | 6/1975 | Pavia | 36/38 |
| 4,660,299 | 4/1987 | Omilusik | 36/27 |

FOREIGN PATENT DOCUMENTS

| | | | |
|---|---|---|---|
| 30597 | 2/1885 | Germany | 36/38 |
| 2431420 | 1/1975 | Germany | 36/38 |
| 322962 | 7/1957 | Switzerland | 36/38 |
| 4271126 | 4/1935 | United Kingdom | 36/38 |
| 2111823 | 7/1983 | United Kingdom | 36/38 |

*Primary Examiner*—Thomas P. Hilliard

[57] ABSTRACT

An athletic shoe device that fits through the wedge sole and insole through a hole in the heel area of a sports shoe, which I named the Roosevelt Spring. The spring is activated with the weight of an athlete, while walking or running, this is done by absorbing the shock and giving energy in sequence to the athlete without losing balance or stability, and causes no pain in the foot. The athlete is also supported by the strength of the spring. It increases the lifetime to the sport shoes and will help be responsible for the decline in sports related injuries, as well as enable man to go farther and faster.

1 Claim, 1 Drawing Sheet

SHOE HEEL SPRING

BACKGROUND

This invention relates to footwear, particularly footwear used for running. I have found that this Shoe Spring has beneficial effects while running.

SUMMARY

My invention is made up of six parts, and two 10–24 hex machine screw nuts, two-10 medium lock-washers, and two 10–24–×5/16 round head machine screws. The spring is held onto the sole wedge using sheet metal discs, and the Shoe Spring sits in a hole cut through the sole of the shoe. The hole and the foot hold the Shoe Spring in place.

DETAILED DESCRIPTION OF THE INVENTION

Figure 1:
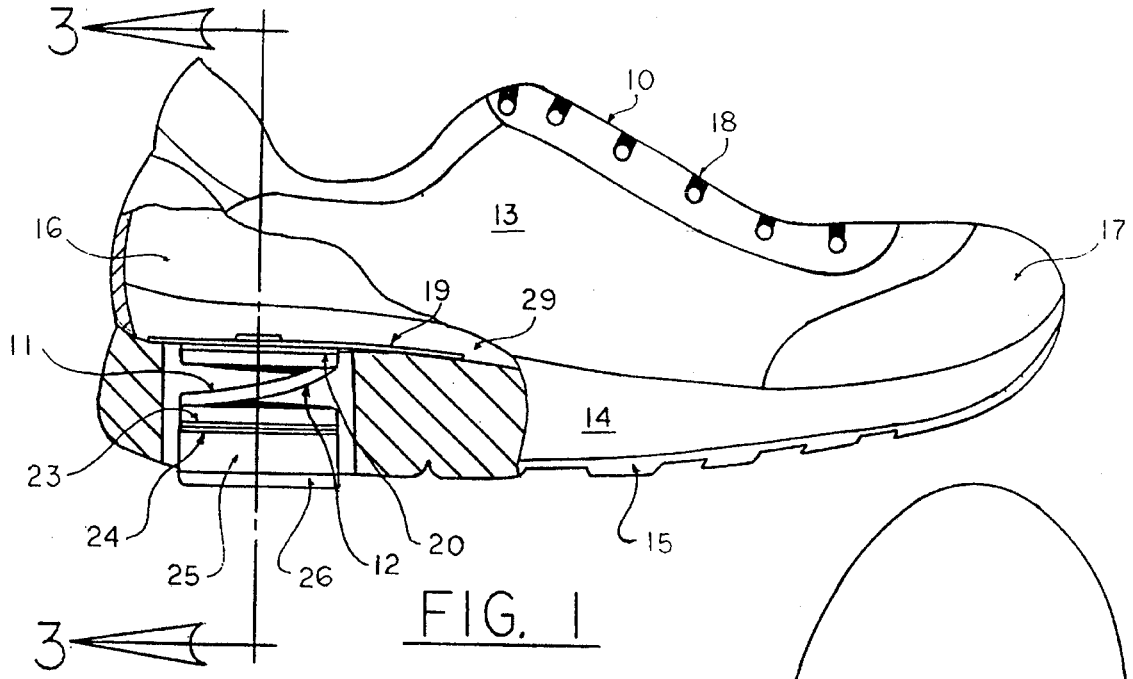
FIG. 1 is the side view.
Figure 3:
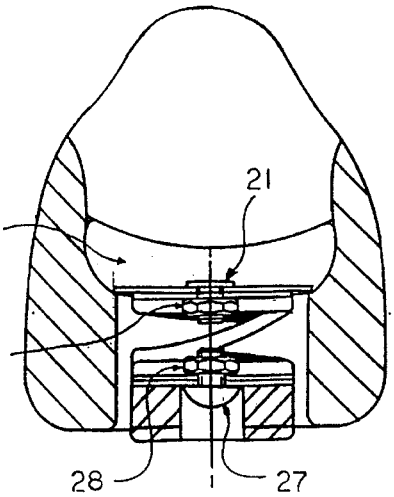
FIG. 3 is a sectional view taken on the line 3—3 of FIG. 1.
Figure 2:
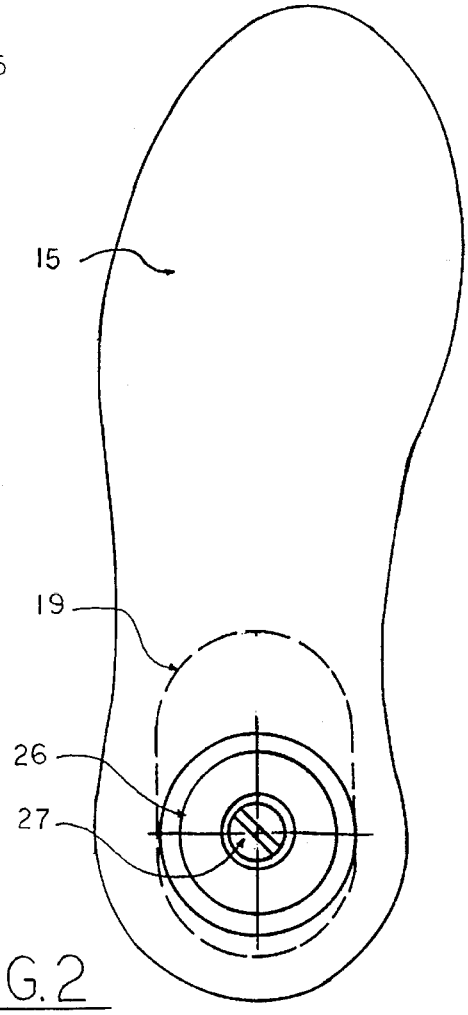
FIG. 2 is a bottom plan view of the device of FIG. 1.

FIG. 1 is a view of my invention. The spring assembly 11 is made up of six parts, and two 10–24 hex machine screw nuts 22, 28, two-10 medium lock-washers, and two 10–24–× 5/16 round head machine screws 21, 27. FIG. 2 shows the six individual parts. The heel protector 19, is made of 20-gauge sheet metal. It lies on top of the sole 29 covering all of the heel area, down to the middle of the arch. It has a 3/16" hole in it. A compression spring 12 made of steel. The steel wire thickness is 3/16", the length is 1", the diameter is 2". Discs 20, 23, 24 made of 20-gauge sheet metal. They are 2" in diameter, and in the center are 3/16" holes. Disc 20 is welded to the top of the spring 12, then the heel protector 19 is attached to disc 23 with a screw lock-washer, and nut. Disc 23 is welded to the bottom of the spring 12. Disc 24 is glued with an all-purpose barge cement to the top of the primer 25 which is made of 3/8" crepe. On the bottom is 1/8" rubber 26. The materials are glued together, cut in a circle 2" in diameter and 1/2" in thickness, and a 3/8" hole drilled through the center. Disc 24 and primer 25 are attached to disc 23 with a screw, lock-washer and nut. FIG. 1 is a sports shoe that has been cut in half and the Shoe Spring has been placed in the heel area of the shoe. In FIG. 2, primer 25 is protruding 3/8" from the sole. FIG. 1 is a standard athletic shoe 10 with an upper 13, rear 16, toe 17, closing means 18, sole 14, and outsole 15, size 91/2 Mens, with a wedge sole. It has a 21/8" plug cut out of the sole, and completely through the soles of the shoe. This is done with a hole saw. The Shoe Spring is inserted through the hole; in FIG. 2 it protrudes 3/8" from the sole. The balance and pressure from the spring are best served at this point on the foot.

FIG. 2 shows that the spring takes up 1" of space in the diameter of the hole when closed with the weight of an athlete. There is 1/4" space left that the shoe provides for breaking the shock. Nothing holds the Shoe Spring in the shoe in place but the hole and the foot of the athlete when the shoe is tied up.

I claim:

1. A shoe comprising:

an upper, a wedge shaped sole, and a spring assembly within the sole under a heel area;

the sole having an outsole;

a main hole bored completely through the sole and the outsole;

the spring assembly located within the main hole, the spring assembly consisting of a heel protector, a compression spring, a cushion member, first, second, and third discs, and fastening means connecting the assembly together, the assembly floating freely inside the main hole such that the assembly is secured to the shoe only by the forces of the foot and the ground;

the heel protector being larger than the main hole, and being located inside the foot receiving area of the shoe, above the sole, the discs, spring, and cushion member having diameters smaller than the main hole, the first disc being located between the heel protector and the spring, the second and third discs being located between the spring and the cushion member, the cushion member having a lower extremity protruding out past the outsole.

* * * * *